US012233350B1

(12) United States Patent
Chen

(10) Patent No.: US 12,233,350 B1
(45) Date of Patent: Feb. 25, 2025

(54) TOY CAR, ACCESSORY THEREOF, AND TOY CAR SYSTEM

(71) Applicant: Zewei Chen, Guangdong (CN)

(72) Inventor: Zewei Chen, Guangdong (CN)

( * ) Notice: Subject to any disclaimer, the term of this patent is extended or adjusted under 35 U.S.C. 154(b) by 0 days.

(21) Appl. No.: 18/420,281

(22) Filed: Jan. 23, 2024

(30) Foreign Application Priority Data

Jan. 18, 2024 (CN) ..... 202420135186.0

(51) Int. Cl.
*A63H 17/26* (2006.01)
*A63H 18/08* (2006.01)
*A63H 29/22* (2006.01)

(52) U.S. Cl.
CPC ..... *A63H 17/262* (2013.01); *A63H 18/08* (2013.01); *A63H 29/22* (2013.01)

(58) Field of Classification Search
CPC ..... A63H 17/00; A63H 17/26; A63H 17/262; A63H 18/02; A63H 18/08; A63H 29/00; A63H 29/22
USPC ..... 446/444, 445, 446, 447, 465; 238/10 R, 238/10 E, 10 F
See application file for complete search history.

(56) References Cited

U.S. PATENT DOCUMENTS 2,920,420 A * 1/1960 Koloziejski ..... A63H 18/12 238/10 F
3,139,237 A * 6/1964 Braverman ..... A63H 18/12 104/111
3,159,109 A * 12/1964 Braverman ..... A63H 18/12 310/154.37
3,209,491 A * 10/1965 Roeper ..... A63H 18/028 238/10 R
3,540,153 A * 11/1970 Masaru ..... A63H 18/08 105/29.2
3,694,958 A * 10/1972 Parker ..... A63H 17/262 29/522.1
4,357,877 A * 11/1982 Mariol ..... A63H 19/00 104/243
4,537,577 A * 8/1985 Sansome ..... A63H 18/08 104/248
4,673,182 A * 6/1987 Bowen ..... A63F 9/14 104/53
4,861,306 A * 8/1989 Bolli ..... A63H 18/08 446/96
4,940,443 A * 7/1990 Hesse ..... A63H 18/02 446/431
5,118,320 A * 6/1992 Miller ..... A63H 18/028 446/288
6,095,892 A * 8/2000 Moe ..... A63H 17/21 446/431
6,626,116 B2 * 9/2003 Clark, Jr. ..... A63H 17/262 238/10 F
6,648,723 B2 * 11/2003 Clark, Jr. ..... A63H 18/12 446/471

(Continued)

*Primary Examiner* — Alexander R Niconovich

(57) ABSTRACT

A toy car includes a housing assembly and a limiting member. The housing assembly is provided with a plurality of wheels rotatable with respect to the housing assembly. The plurality of wheels is configured for engaging on an upper surface of a block and rolling along the upper surface of the block. The limiting member is connected to the housing assembly. The limiting member is configured for abutting against a side surface of the block, and the limiting member is used for limiting the plurality of wheels on the upper surface of the block.

6 Claims, 12 Drawing Sheets

(56) References Cited

U.S. PATENT DOCUMENTS

| | | | | |
|---|---|---|---|---|
| 7,770,524 | B1 * | 8/2010 | Wa | A63H 18/08 105/29.2 |
| 7,938,068 | B2 * | 5/2011 | Parker | A63H 19/34 104/53 |
| 9,114,324 | B2 * | 8/2015 | Chuang | A63H 19/24 |
| 11,117,064 | B2 * | 9/2021 | Choi | A63H 18/026 |
| 2007/0066180 | A1 * | 3/2007 | Marietta | A63H 17/00 446/56 |
| 2007/0259600 | A1 * | 11/2007 | Bedford | A63H 21/04 446/444 |
| 2018/0333649 | A1 * | 11/2018 | Mucaro | A63H 17/26 |

* cited by examiner

TOY CAR, ACCESSORY THEREOF, AND TOY CAR SYSTEM

CROSS-REFERENCE TO RELATED APPLICATIONS

The application claims priority of Chinese patent application CN202420135186.0, filed on Jan. 18, 2024, which is incorporated herein by reference in its entireties.

TECHNICAL FIELD

The present disclosure relates to the field of toy cars, in particular to an accessory thereof, and a toy car system

BACKGROUND ART

With the continuous progress of the times and people's concern for children's growth, toy cars, as one of the classics toys for children, can exercise hand-eye coordination and develop intelligence, so they are highly favored by users all over the world.

However, there is a common problem in the current toy cars, which is the adaptability between the track and the toy car. Traditional track design usually needs to precisely match the size and structure of the toy car to ensure that the toy car can smoothly run on the track. This greatly limits the use of toy car products, resulting in production and design constraints, and in the event that one of the toy cars or toy tracks is damaged, the user is forced to purchase an entire new product to match. Moreover, since different sizes or types of toy cars may require different tracks, it greatly increases the complexity of manufacturing and production costs.

Accordingly, the present invention provides a toy car that can effectively solve the above problems, and can realize that different shapes of toy cars can be adapted to fit the same track building blocks, which greatly reduces the production and manufacturing costs.

SUMMARY

A toy car includes a housing assembly and a limiting member. The housing assembly is provided with a plurality of wheels rotatable with respect to the housing assembly. The plurality of wheels is configured for engaging on an upper surface of a block and rolling along the upper surface of the block. The limiting member is connected to the housing assembly. The limiting member is configured for abutting against a side surface of the block, and the limiting member is used for limiting the plurality of wheels on the upper surface of the block.

Further, the limiting member includes an abutting portion connected to the plurality of wheels, the abutting portion is provided on a side of the plurality of wheels away from the housing assembly, and the abutting portion is used for abutting against the side surface of the block.

Further, the limiting member comprises a first limiting arm and a second limiting arm, the first limiting arm and the second limiting arm are integrally formed, the first limiting arm is provided with a first connecting shaft, the first connecting shaft is connected to a first guide wheel; the second limiting arm is provided with a second connecting shaft, the second connecting shaft is connected with a second guide wheel, the first guide wheel and the second guide wheel are for abutting against the side surface of the block.

Further, the limiting member is detachably connected to the housing assembly.

Further, wherein the first guide wheel is rotatably connected around the first connecting shaft and the second guide wheel is rotatably connected around the second connecting shaft.

Further, the limiting member is connected to a side wall of the housing assembly, the limiting member comprising a third limiting arm and a fourth limiting arm, the third limiting arm and the fourth limiting arm are connected to opposite side walls of the housing assembly respectively; the third limiting arm is provided with a third connecting shaft, the third connecting shaft is connected with a third guide wheel; the fourth limiting arm is provided with a fourth connecting shaft, the fourth connecting shaft is connected with a fourth guide wheel; the third guide wheel and the fourth guide wheel are used for abutting against the side surface of the block.

Further, the third guide wheel is rotatably connected around the third connecting shaft, and the fourth guide wheel is rotatably connected around the fourth connecting shaft.

Further, the third limiting arm and the fourth limiting arm are rotatably connected to the housing assembly.

Further, the housing assembly is provided with a first connecting member and a second connecting member on opposite side walls, the first connecting member is provided with a first connecting hole, the third limiting arm is provided with a first rotary shaft, the first rotary shaft is located in the first connecting hole, and the fourth limiting arm is rotatably connected with the third limiting arm, the third limiting arm is rotatable relative to the housing assembly via the first rotary shaft; the second connecting member is provided with a second connecting hole, the fourth limiting arm is provided with a second rotary shaft, the second rotary shaft is located in the second connecting hole, the fourth limiting arm is rotatable relative to the housing assembly via the second rotary shaft.

Further, the first guide wheel has a diameter in a range of 0.5 cm-2.5 cm and the second guide wheel has a diameter in a range of 0.5 cm-2.5 cm.

Further, a maximum size of the limiting member is greater than or equal to a distance between the two opposite wheels.

Further, the toy car further includes a driving device and a battery, wherein the housing assembly is provided with an accommodation cavity, the driving device as well as the battery are received in the accommodation cavity; the driving device is for driving the plurality of wheels to rotate, the battery is electrically connected to the driving device, and the battery is used for supplying power to the driving device.

An accessory for a toy car includes a limiting member. The limiting member is for connecting to a housing assembly of a toy car and for abutting against a side surface of a block. The limiting member is for limiting the plurality of wheels connected to the housing assembly to an upper surface of the block.

Further, the limiting member comprises an abutting portion connected to the plurality of wheels, the abutting portion being provided on the side of the plurality of wheels away from the housing assembly, and the abutting portion is used for abutting against a side surface of the block.

Further, the limiting member is provided at a lower end of the housing assembly, the limiting member comprising a first limiting arm and a second limiting arm, the first limiting arm and the second limiting arm are integrally formed; the first limiting arm is provided with a first connecting shaft, the first connecting shaft is connected to a first guide wheel; the second limiting arm is provided with a second connecting shaft, the second connecting shaft is connected to a second guide wheel, the first guide wheel and the second guide wheel are for abutting against the side surface of the block.

Further, the limiting member is detachably connected to the housing assembly.

Further, the first guide wheel is rotatably connected around the first connecting shaft and the second guide wheel is rotatably connected around the second connecting shaft.

Further, the limiting member is connected to a side wall of the housing assembly, the limiting member comprising a third limiting arm and a fourth limiting arm, the third limiting arm and the fourth limiting arm are connected to opposite side walls of the housing assembly respectively; the third limiting arm is provided with a third connecting shaft, the third connecting shaft is connected with a third guide wheel; the fourth limiting arm is provided with a fourth connecting shaft, the fourth connecting shaft is connected with a fourth guide wheel; the third guide wheel and the fourth guide wheel are for abutting against the side surface of the block.

Further, the housing assembly is provided with a first connecting member and a second connecting member on two opposite side walls; the first connecting member is provided with a first connecting hole, and the third limiting arm is provided with a first rotary shaft, the first rotary shaft is located in the first connection hole, the third limiting arm is rotatable around the first rotary shaft relative to the housing assembly; the second connecting member is provided with second connection hole, the fourth limiting arm provided with a second rotary shaft, the second rotary shaft is located in the second connection hole, the fourth limiting arm is rotatable around the second rotary shaft relative to the housing assembly.

A toy car system includes a block, a toy car, and a limiting member. The block has an upper surface and a side surface. The toy car includes a housing assembly and a plurality of wheels provided on the housing assembly. The plurality of wheels is rotatable with respect to the housing assembly. The plurality of wheels is configured for engaging on an upper surface of the block and rolling along the upper surface of the block. The limiting member is connected to the housing assembly and for abutting against the side surface. The limiting member is for limiting the plurality of wheels on the upper surface of the block.

With the above structure, when the toy car is used, the toy car is placed on the block, so that the wheels tightly abut against the upper surface of the block, and the limiting member tightly abuts against the two opposite side surfaces of the block. When the toy car is moving, the limiting member always abuts against the side surfaces of the block so that the toy car can travel in the aligned, extending direction of the block. The wheels provide power for the toy car to move forward through friction, and the limiting member can always limit the wheels of the toy car to be located on the upper surface of the blocks, so that the toy car can run more stably. The design effectively realizes that different shapes of the toy car can be adapted to the same track blocks, which greatly reduces the manufacturing cost.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
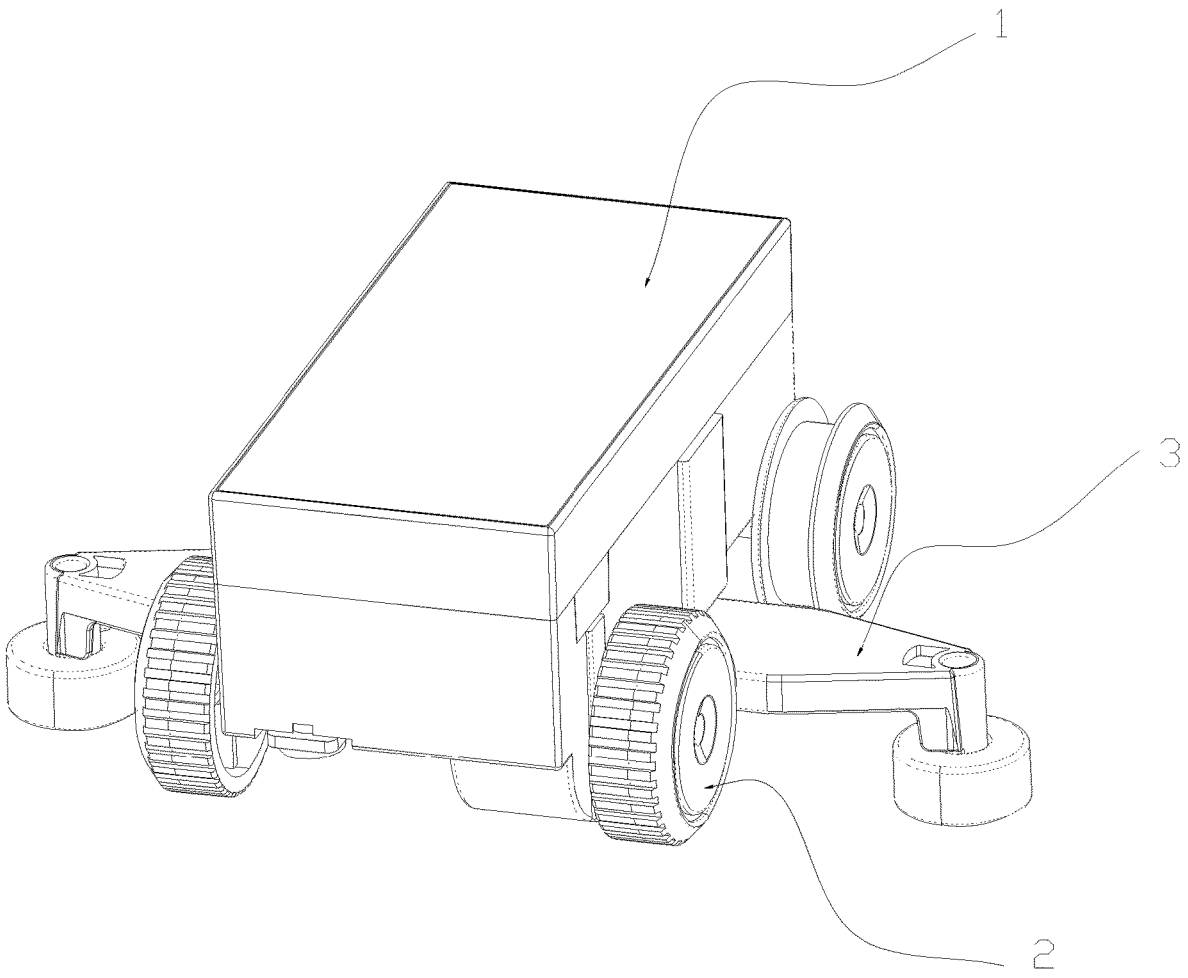
FIG. 1 is a schematic diagram of the overall structure of the toy car of the invention.
Figure 2:
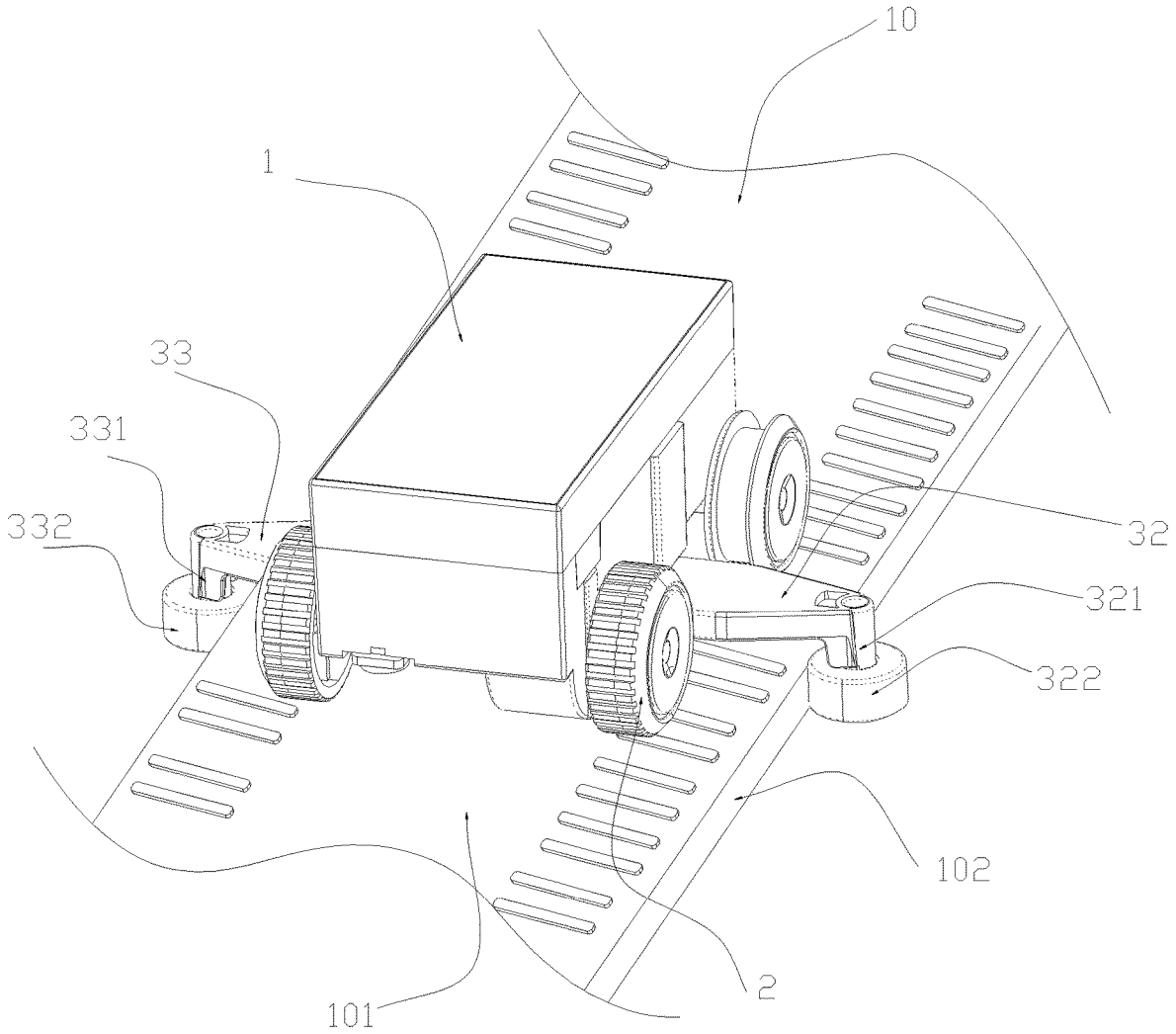
FIG. 2 is a schematic diagram of the toy car of the present invention cooperating with a block.
Figure 3:
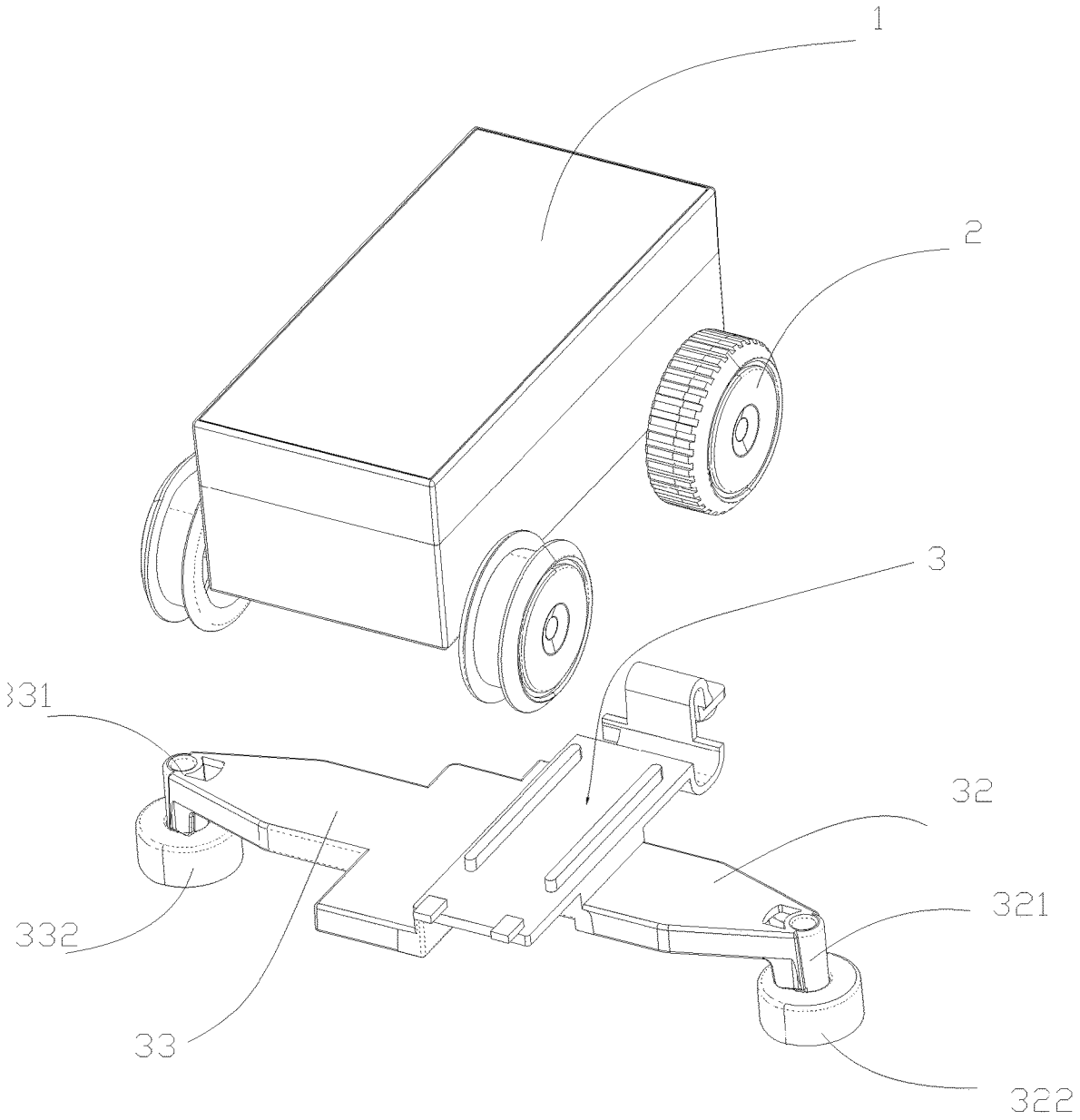
FIG. 3 is an exploded view of the toy car of the invention.
Figure 4:
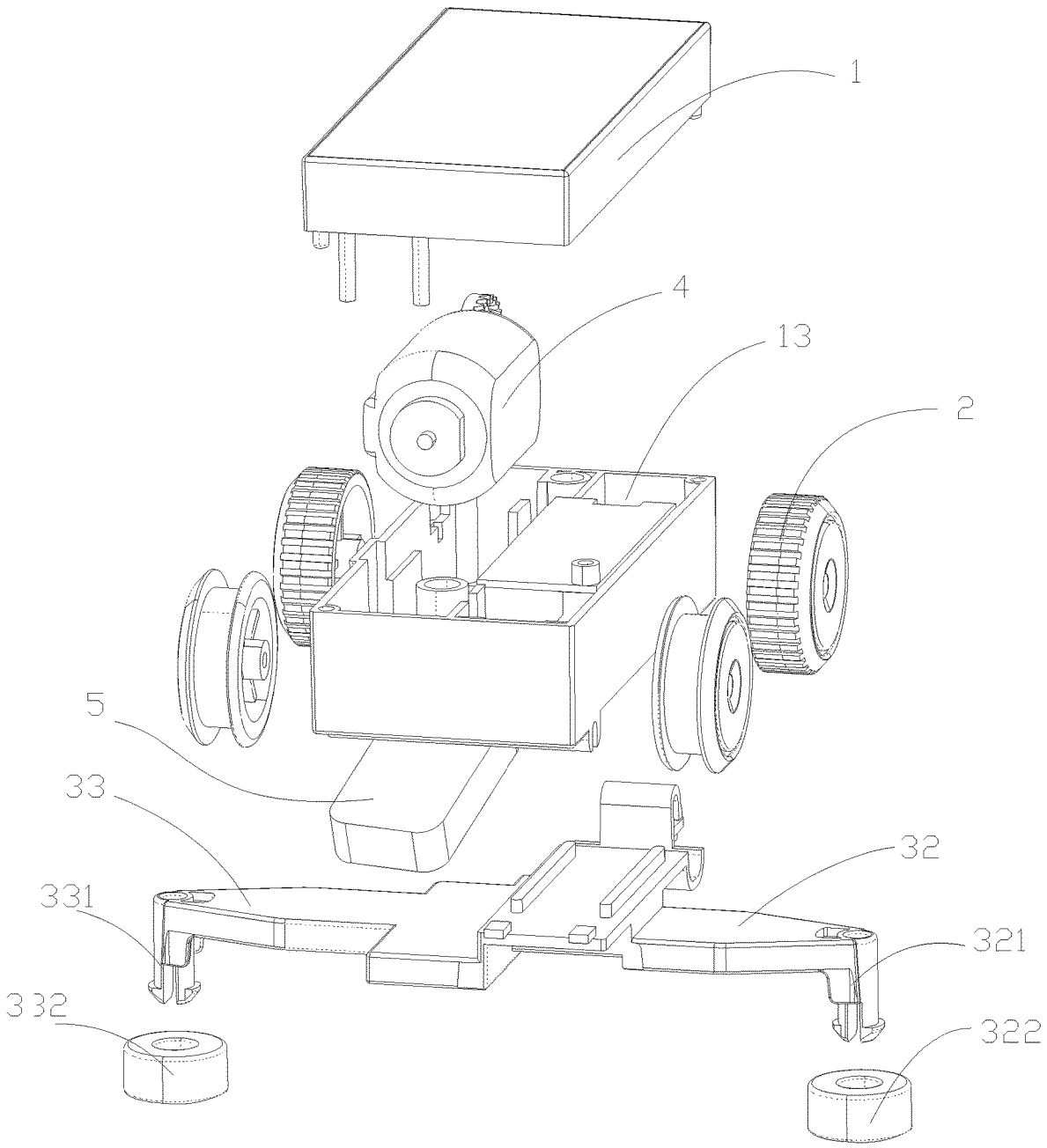
FIG. 4 is another exploded view of the toy car of the invention.
Figure 5:
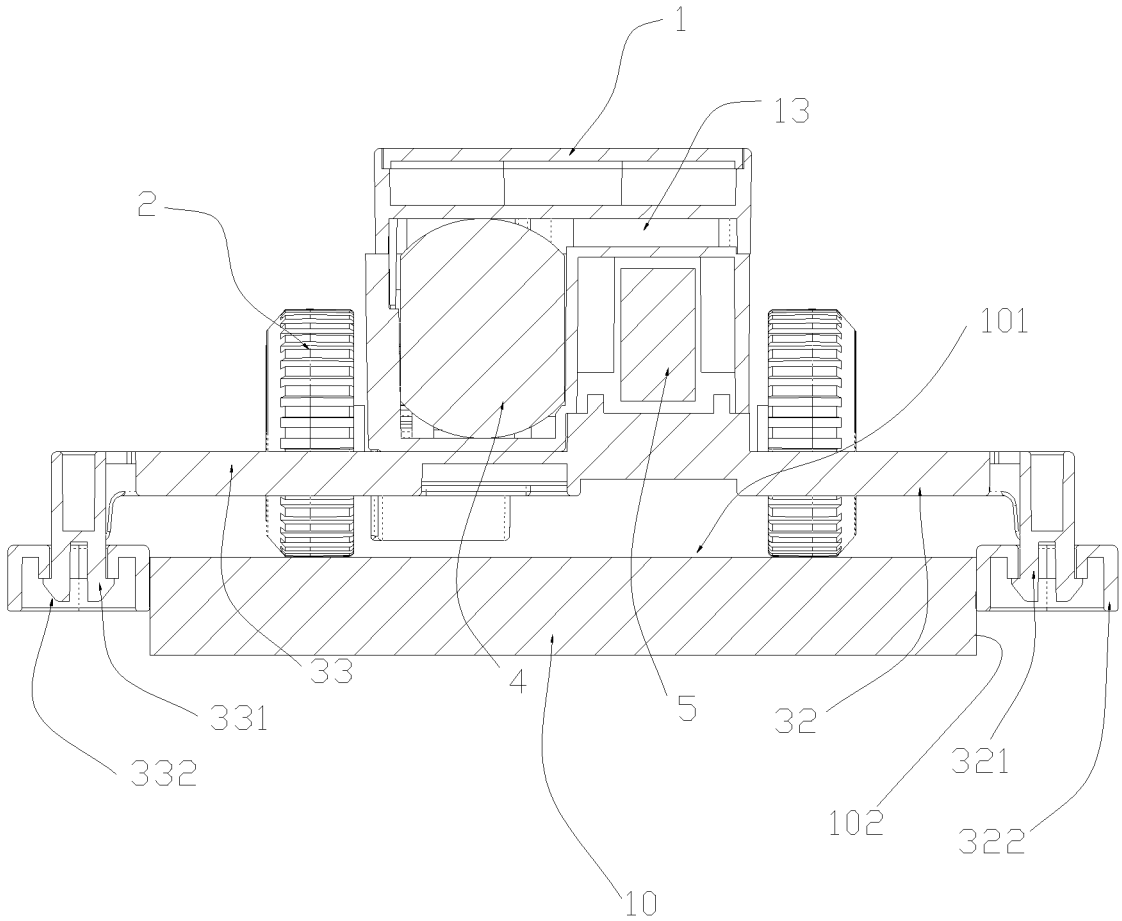
FIG. 5 is a cross-sectional view of the toy car of the invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Referring to FIGS. 1 to 5, a toy car includes a housing assembly 1 and a limiting member 3. The housing assembly 1 is provided with a wheel 2 rotatable with respect to the housing assembly 1. The wheel 2 is used to engage on an upper surface 101 of the building block 10 and roll along the upper surface 101 of the building block 10. A limiting member 3 is connected to the housing assembly 1 and is used to abut against the side surface 102 of the block 10, and the limiting member 3 is used to limit the wheel 2 to the upper surface 101 of the block 10. With the above structure, when the toy car is used, the toy car is placed on the block 10, so that the wheel 2 tightly abuts against the upper surface 101 of the block 10, and the limiting member 3 tightly abuts against the two opposite side surfaces 102 of the block 10. When the toy car is moving, the limiting member 3 always abuts against the side surfaces of the block 10 so that the toy car can travel in the aligned, extending direction of the block 10. The wheels 2 provide power for the toy car to move forward through friction, and the limiting member 3 can always limit the wheels 2 of the toy car to be located on the upper surface of the blocks, so that the toy car can run more stably. The design effectively realizes that different shapes of the toy car can be adapted to the same track blocks, which greatly reduces the manufacturing cost.

Figure 6:
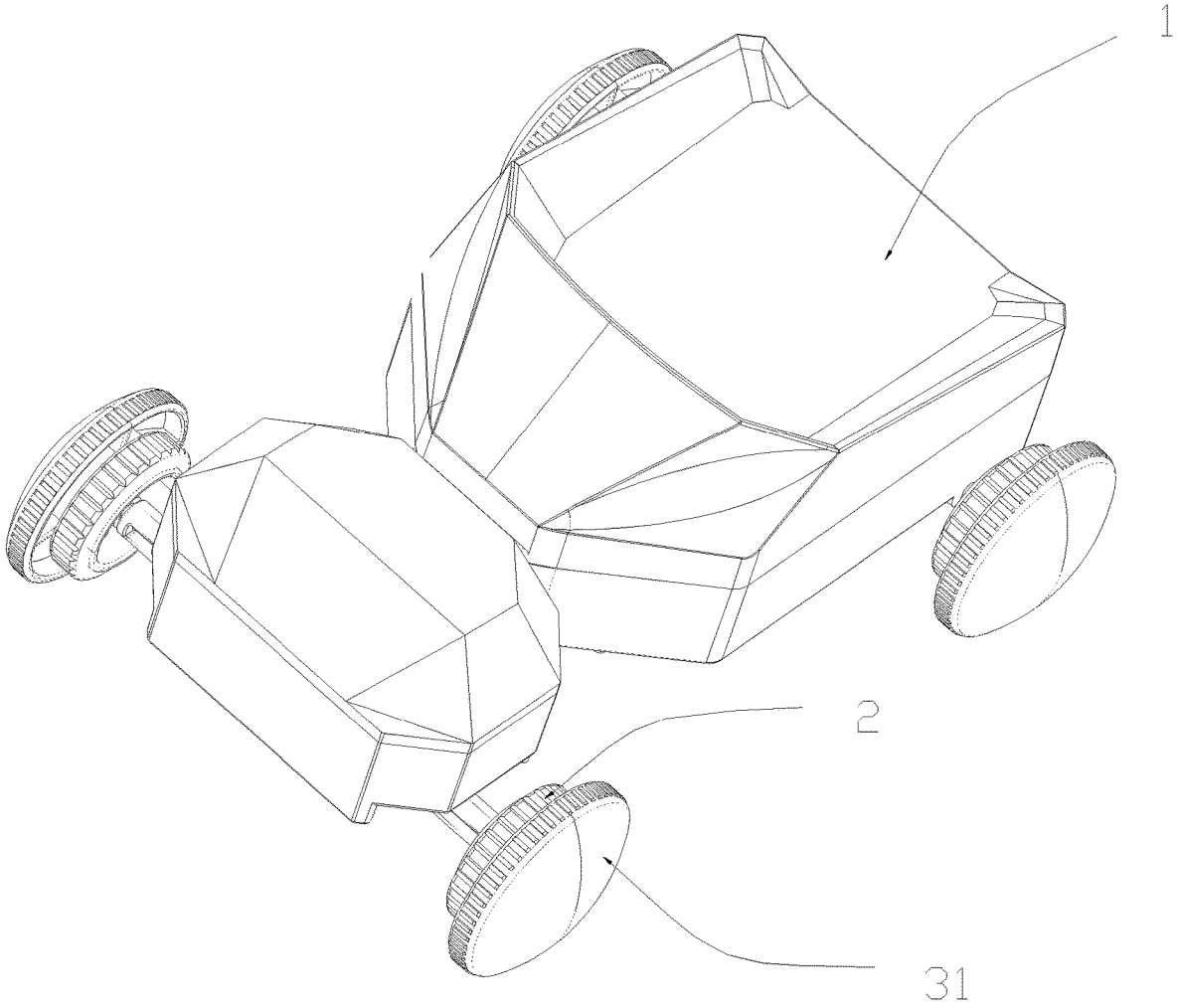
FIG. 6 is a schematic diagram of the overall structure of an embodiment of the invention.
Figure 7:
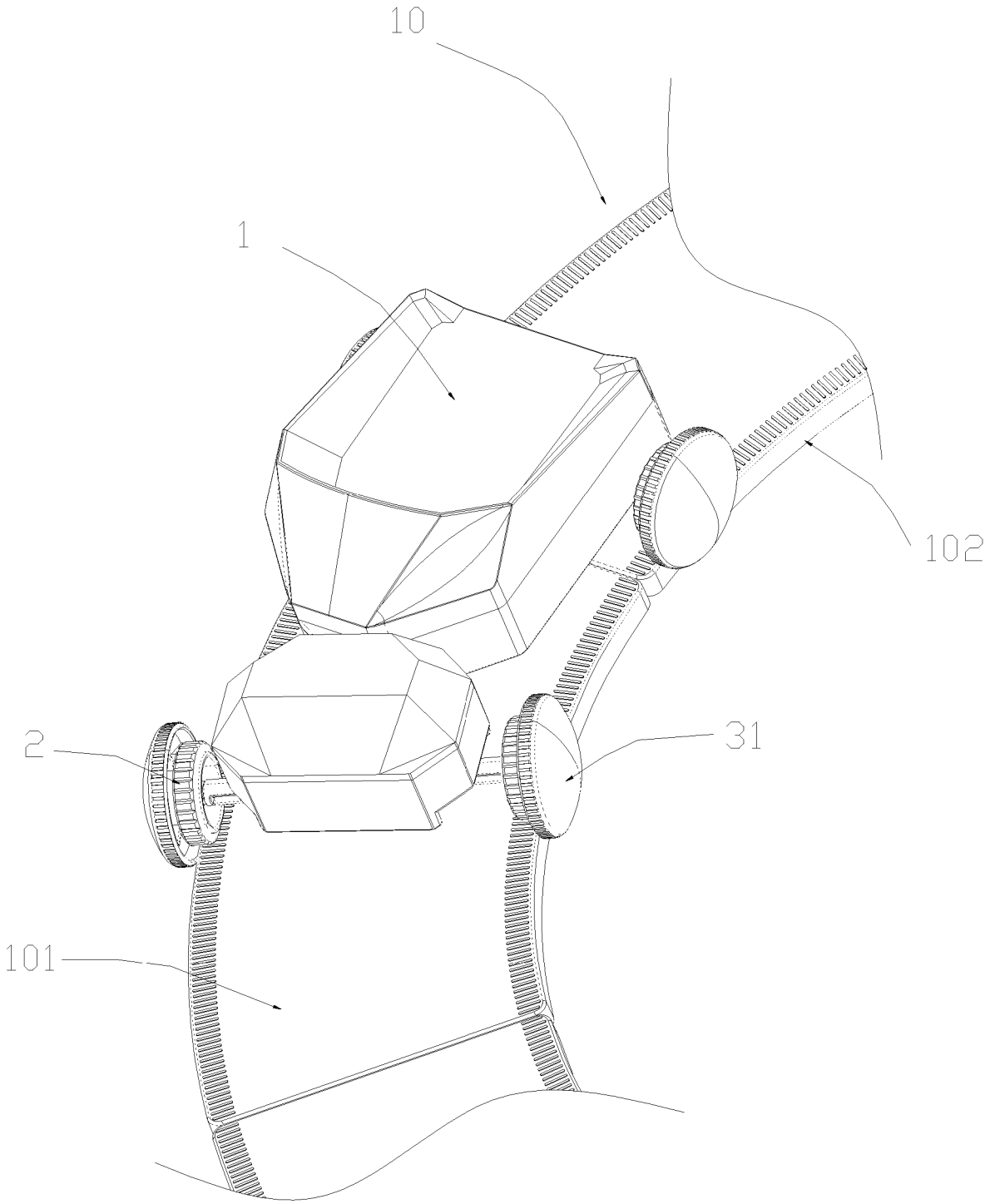
FIG. 7 is a schematic diagram of a toy car of an embodiment of the present invention cooperating with a block.
Figure 8:
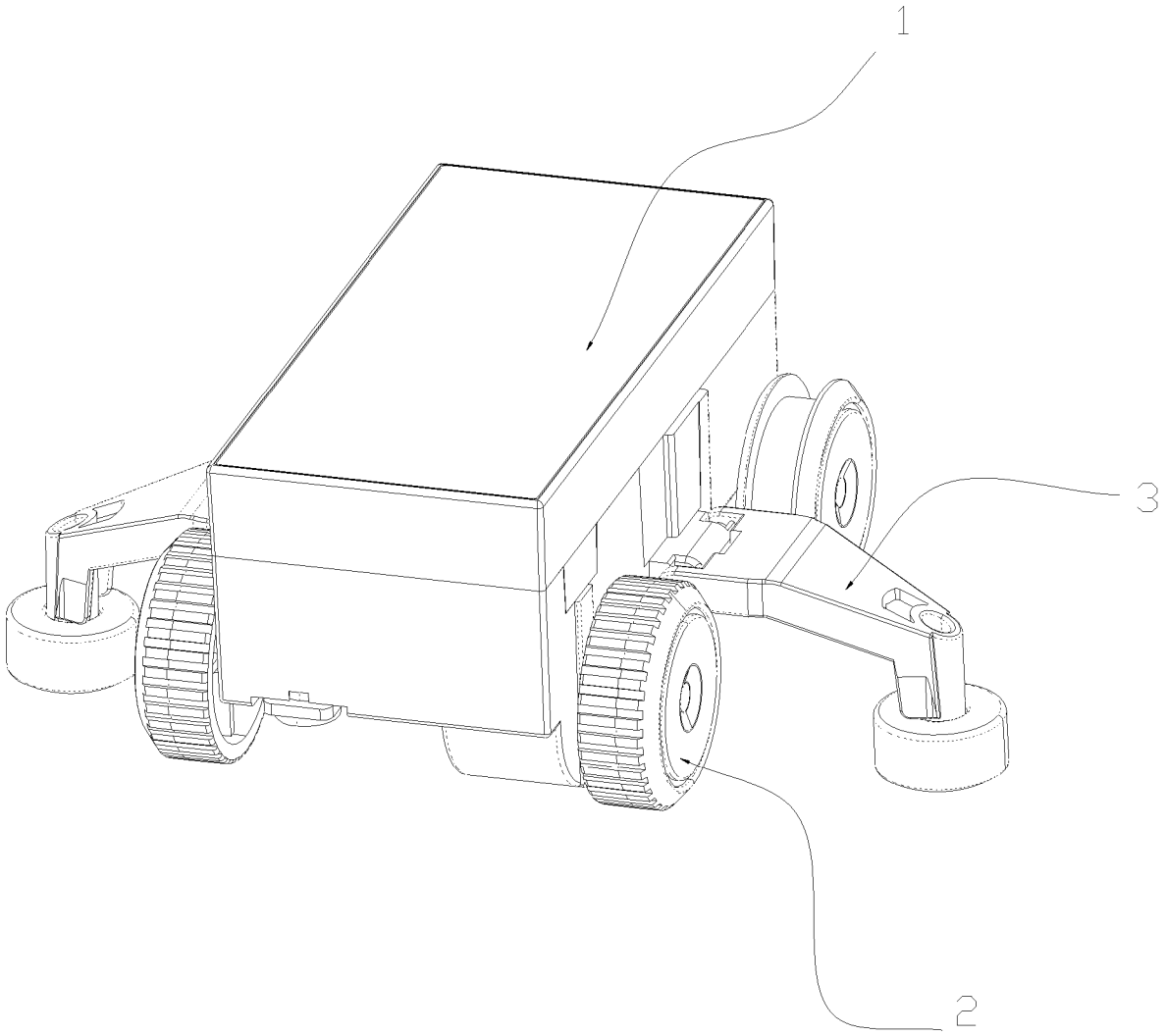
FIG. 8 is a schematic diagram of structure toy car of another embodiment of the invention.
Figure 9:
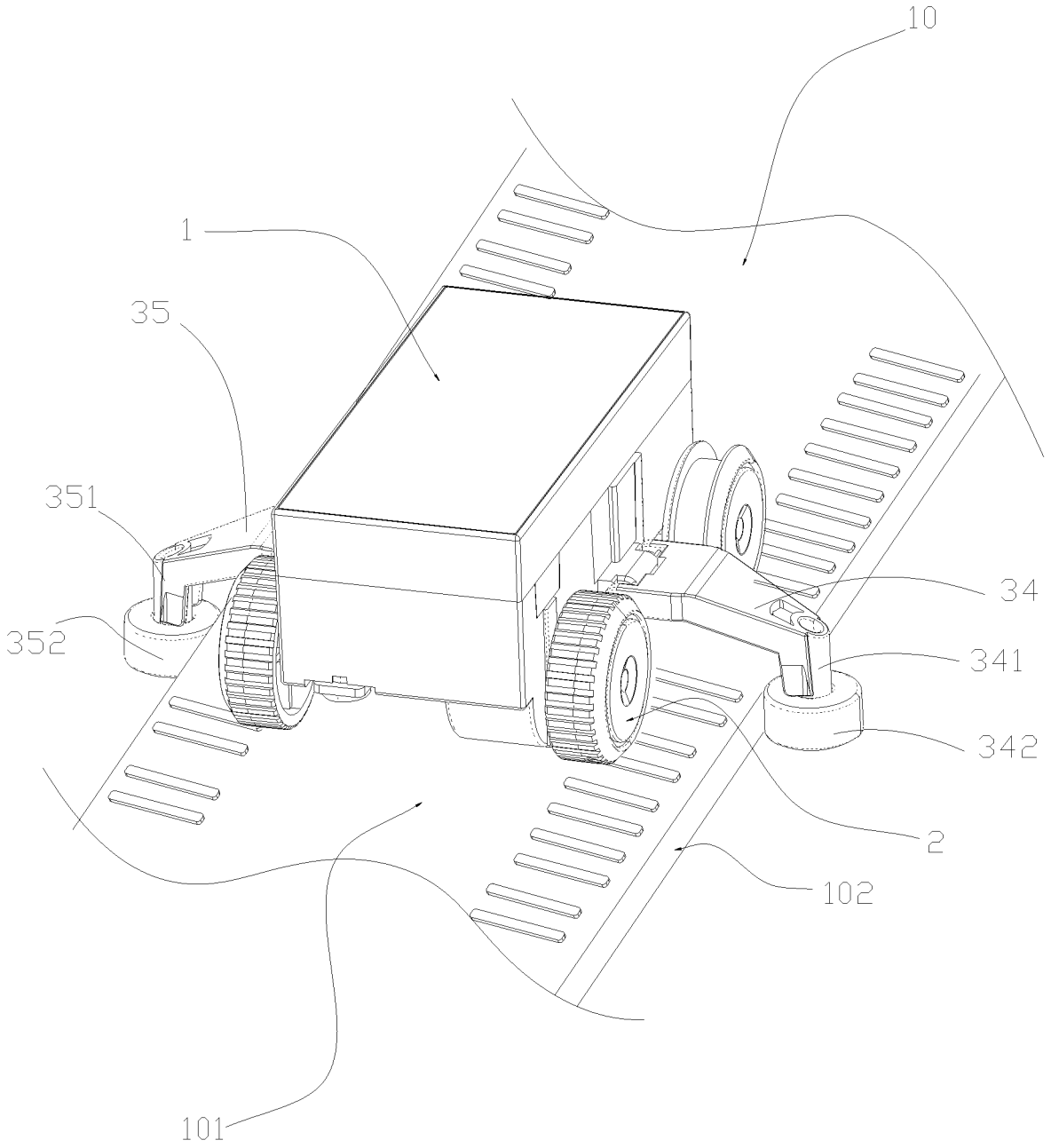
FIG. 9 is a schematic diagram of another embodiment of the invention in which a toy car cooperates with a block.
Figure 10:
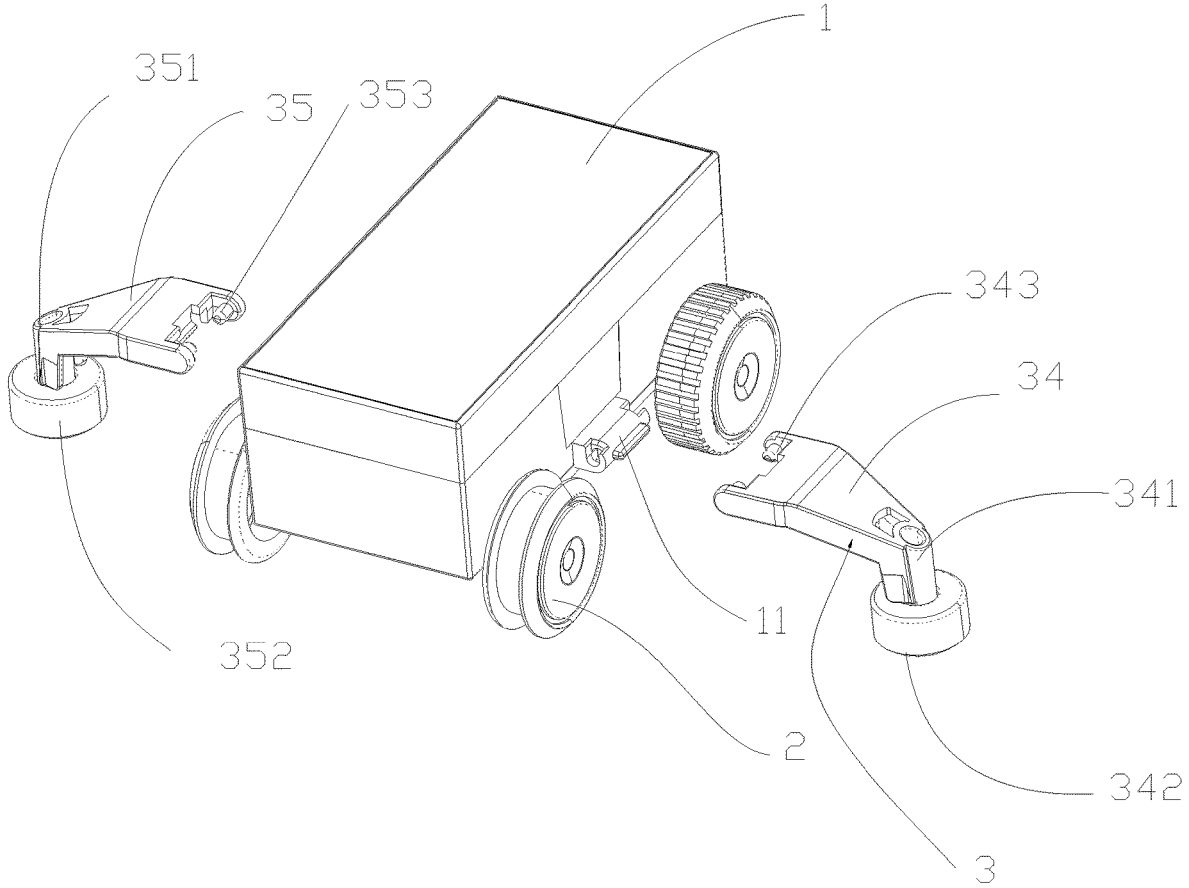
FIG. 10 is an exploded view of a toy car according to another embodiment of the invention.
Figure 11:
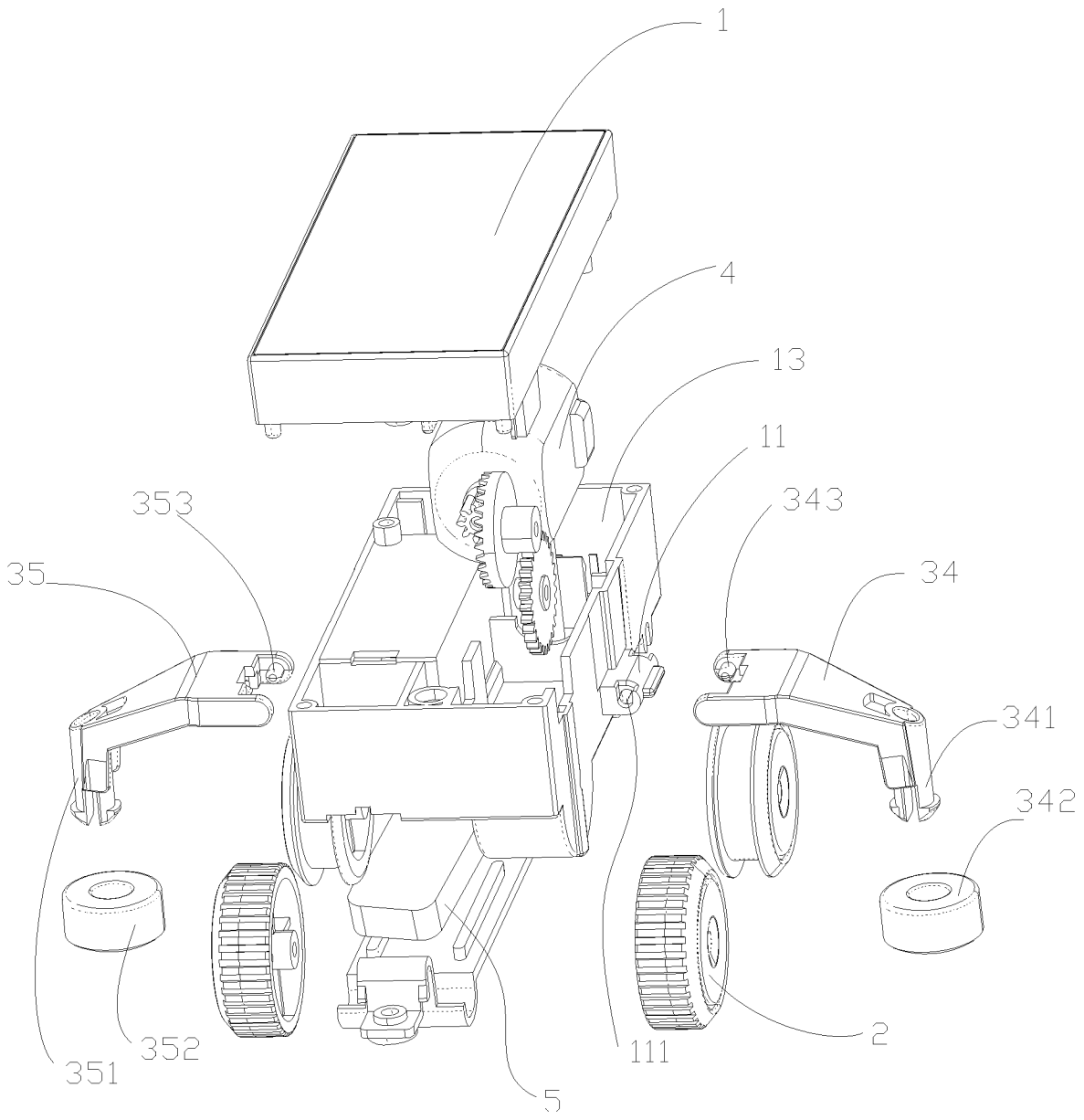
FIG. 11 is another exploded view of a toy car according to another embodiment of the present invention.
Figure 12:
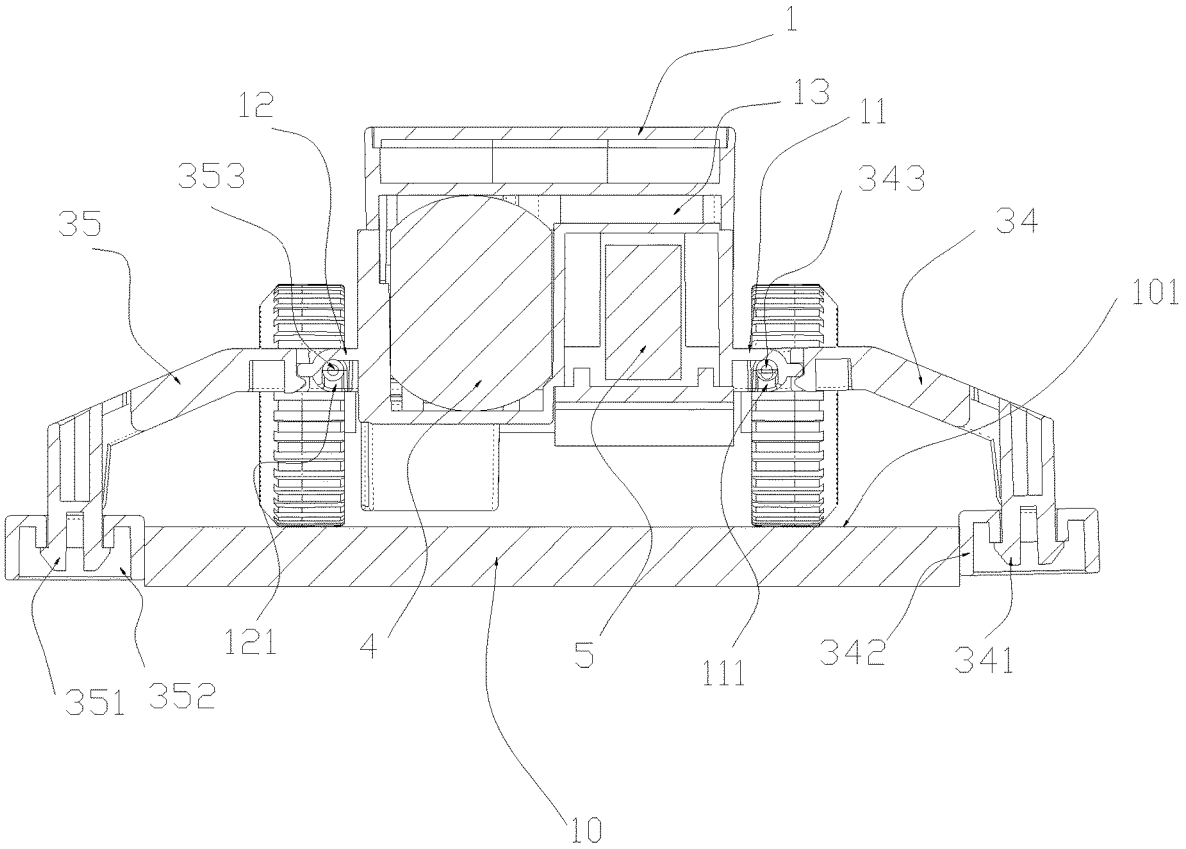
FIG. 12 is cross-sectional view of a toy car according to another embodiment of the present invention.

In one embodiment, with reference to FIGS. 6-7, the limiting member 3 includes an abutting portion 31 connected to the wheel 2, the abutting portion 31 is disposed on one side of the wheel 2 away from the housing assembly 1, and the abutting portion 31 is used for abutting against the side surface 102 of the block 10. With the above structure, the abutting portion 31 is always abutting against the side surface 102 of the block 10 when the toy car is moving so that the toy car travels along the arrangement and extension direction of the block 10. The wheels 2 provide power for the toy car to move forward through friction, and the abutting portion 31 can always limit the toy car, so that the toy car operates more stably and greatly reduces the manufacturing cost.

In this embodiment, the limiting member 3 can be provided at a lower end or an upper end of the housing assembly 1, and the limiting member 3 includes a first limiting arm 32 and a second limiting arm 33. The first limiting arm 32 and the second limiting arm 33 are integrally formed. The first limiting arm 32 is provided with a first connecting shaft 321, and the first connecting shaft 321 is connected to a first guide wheel 322. The second limiting arm 33 is provided with a second connecting shaft 331, and the second connecting shaft 331 is connected to a second guide wheel 332. The first guide wheel 322 and the second guide wheel 332 are used for abutting against the side surfaces 102 of the block 10. Through the above structure, since the limiting member 3 is connected and fixed to the housing assembly and is provided at the lower end of the housing assembly 1, the housing assembly 1 and the wheels 2 can be limited to the upper surface of the block 10 at all times in a way that through the first guide wheel 322 and the second guide wheel 332 abut against the side surface 102 of the block 10. This effectively realizes the function of limiting, makes the toy car run more stably and greatly reduces manufacturing costs.

In this embodiment, the limiting member 3 is detachably connected to the housing assembly 1. The limiting member 3 and the shell assembly 1 are connected by a snap-fit connection or a threaded connection. With the above structure, the removable limiting member 3 allows users to use different toy cars on the same track, thereby reducing the need to purchase additional matching track blocks, which helps to reduce production and purchasing costs, and provides consumers with a more economical choice. The snap-fit connection allows for easy and quick assembly and disassembly, facilitating the replacement of the limiting component 3. The threaded connection provides a stronger connection, which can enhance the stability of the connection between the limiting component 3 and the housing assembly 1.

In this embodiment, the first guide wheel 322 is rotatably connected around the first connecting shaft 321, and the second guide wheel 332 is rotatably connected around the second connecting shaft 331. With the above structure, compared to the non-rotatable guide wheels, the rotatable guide wheels enable the limiting member 3 to move more flexibly and smoothly on the curve of the track blocks, and help to reduce the friction between the limiting member 3 and the block 10, so that the toy car is able to glide on the block 10 more easily. This helps to improve the smoothness of the toy car.

In one embodiment, referring to FIGS. 8-12, the limiting member 3 is connected to side walls of the housing assembly 1. The limiting member 3 includes a third limiting arm 34 and a fourth limiting arm 35, and the third limiting arm 34 and the fourth limiting arm 35 are connected to opposite side walls of the housing assembly 1, respectively. The third limiting arm 34 is provided with a third connecting shaft 341, which is connected to a third guide wheel 342; and the fourth limiting arm 35 is provided with a fourth connecting shaft 351, which is connected to a fourth guide wheel 352, and the third guide wheel 342 and the fourth guide wheel 352 are used for abutting against the side surfaces 102 of the block 10. Through the above structure, since the limiting component 3 is connected to the side walls of the housing assembly 1, the third guide wheel 342 and the fourth guide wheel 352 abut against the side surfaces 102 of the block 10. In this way, the limiting component 3 can always limit the housing assembly 1 and the wheel 2 on the upper surface of the block 10, effectively realizing the role of the limiting, making the toy car run more stably, and greatly reducing the manufacturing cost.

Further, the third guide wheel 342 is rotatably connected around the third connecting shaft 341, and the fourth guide wheel 352 is rotatably connected around the fourth connecting shaft 351. With the above structure, compared to the non-rotatable guide wheel, the rotatable guide wheel enables the limiting member 3 to move more flexibly and smoothly on a curved track (i.e., path) formed by the blocks, and helps to reduce the friction between the limiting member 3 and the block 10, so that the toy car can glide on the block 10 more easily, which helps to improve the smoothness of the toy car.

Further, the third limiting arm 34 and the fourth limiting arm 35 are rotatably connected to the housing assembly 1. Specifically, the third limiting arm 34 and the fourth limiting arm 35 are rotatably foldable to the side wall of the housing assembly 1. With the above structure, the rotatable and foldable third limiting arm 34 and the fourth limiting arm 35 can be folded into a smaller space when the toy car is not in use, thereby reducing the size when stored and carried. This makes the toy car easier to carry and store, and is convenient for the user to use when needed.

Further, the two opposite side walls of the housing assembly 1 are respectively provided with a first connecting member 11 and a second connecting member 12, the first connecting member 11 is provided with a first connecting hole 111, and the third limiting arm 34 is provided with a first rotary shaft 343, the first rotary shaft 34 being disposed within the first connecting hole 111, and the third limiting arm 34 rotates with respect to the housing assembly 1 via the first rotary shaft 343. The second connecting member 12 is provided with a second connecting hole 121, the fourth limiting arm 35 is provided with a second rotary shaft 353, the second rotary shaft 353 is disposed within the second connecting hole 121, and the fourth limiting arm 35 rotates relative to the housing assembly 1 via the second rotary shaft 353. Through the above structure, the function that the limiting member can be rotated and folded is effectively realized, thereby reducing the volume when storing and carrying, making the toy car easier to carry and store, and facilitating the use of the toy car by the user when needed, and improving the portability and storage convenience of the toy car.

In the present embodiment, the diameter of the first guide wheel 322 is in the range of 0.5 cm-2.5 cm, and the diameter of the second guide wheel 332 is in the range of 0.5 cm-2.5 cm. With the above structure, the guide wheels within the range help maintain the stability of the toy car on the track. If the guide wheel is too large, the toy car may be easily rolled over on its side (toy car rollover); if the guide wheel is too small, the toy car may be unstable on the track.

In this embodiment, the maximum size of the limiting member 3 is greater than or equal to the distance between the two opposite guide wheels 2. Through the above structure, it is ensured that the limiting member 3 can abut against the side walls of the block 10 and effectively play the role of limiting, and the reliability of the limiting member 3 is guaranteed.

In this embodiment, the housing assembly 1 is provided with an accommodation cavity 13, the driving device 4 and the battery 5 are provided in the accommodation cavity 13, the driving device 4 drives the wheel 2 to rotate, and the battery 5 is electrically connected to the driving device 4, and the battery 5 is used to supply power to the driving device 4. Through the above structure, the driving device 4 can drive the wheel 2 to rotate, which can realize that the toy car automatically moves on the surface of the block 10, freeing the user's hands and increasing the fun of the product. Setting the driving device 4 in the accommodation cavity 13 can effectively protect and hide the driving device 4, further enhance the stability and aesthetics of the product, and attract users to purchase the product.

Referring to FIGS. 1 to 5, an accessory for a toy car includes a limiting member 3. The limiting member 3 is used to connect with the housing assembly 1 of the toy car and to be used to abut against the side surface 102 of the block 10. The limiting member 3 is used to limit the wheels 2 connected to the housing assembly 1 on the upper surface 101 of the block 10. With the above structure, when using the toy car, the toy car is placed on the block 10, so that the wheels 2 are tightly rested on the upper surface 101 of the block 10. The limiting member 3 abuts against the two opposite side surfaces 102 of the block 10, and the limiting member 3 always abuts against the side surfaces of the block 10 when the toy car is moving, so that the toy car can travel along the aligned, extending direction of the block 10. The wheels 2 provide power for the toy car to move forward through friction, and the limiting member 3 can always limit the wheels 2 of the toy car to be located on the upper surface of the blocks, so that the toy car can run more stably. The design effectively realizes that different shapes of the toy car can be adapted to the same track blocks, which greatly reduces the manufacturing cost.

In one embodiment, with reference to FIGS. 6-7, the limiting member 3 includes an abutting portion 31 connected to the wheel 2, the abutting portion 31 is disposed on the side of the wheel 2 departing from the housing assembly 1, and the abutting portion 31 is used to abut against the side surface 102 of the block 10. With the above structure, the abutting portion 31 is always abutting against the side surface 102 of the block 10 when the toy car is moving to make the toy car travel in the alignment and extension direction of the block 10, so that the toy car can run more stably in the direction of the arrangement, and extending of the blocks 10. The wheels 2 provide power for the toy car to move forward through friction, and the abutting portion 31 can always limit the toy car, so that the toy car can run more stably, greatly reducing the manufacturing cost.

In this embodiment, the limiting component 3 is provided at the lower end of the housing assembly 1, and the limiting component 3 includes a first limiting arm 32 and a second limiting arm 33. The first limiting arm 32 and the second limiting arm 33 are integrally formed. The first limiting arm 32 is provided with a first connecting shaft 321, the first connecting shaft 321 is connected to a first guide wheel 322, the second limiting arm 33 is provided with a second connecting shaft 331, and the second connecting shaft 331 is connected to a second guide wheel 332. The first guide wheel 322 and the second guide wheel 332 are connected to the side surfaces 102 of the block 10. Through the above structure, since the limiting member 3 is connected to the housing assembly and fixed at the lower end of the housing assembly 1, the first guide wheel 322 and the second guide wheel 332 are connected to the side surface 102 of the block 10, and the housing assembly 1 and the wheels 2 are always limited to the upper surface of the block 10, which effectively realizes the limiting function of the housing assembly 1 and the wheels 2. The upper surface of the block 10, effectively realizing the role of the limit, so that the toy car more stable operation, greatly reducing the manufacturing cost.

In this embodiment, the limiting member 3 is detachably connected to the housing assembly 1; the limiting member 3 is connected to the housing assembly 1 by snap-fit connection or threaded connection. With the above structure, the detachable limiting member 3 allows users to use different toy cars on the same track, thereby reducing the need to purchase additional matching track blocks, which helps to reduce production and purchasing costs, and provides consumers with a more economical choice. The snap-fit connection can be easily and quickly assembled and disassembled, facilitating the replacement of the limiting component 3. The threaded connection provides a stronger connection, which can enhance the stability of the connection between the limiting component 3 and the housing assembly 1.

In this embodiment, the first guide wheel 322 is rotatably connected around the first connecting shaft 321, and the second guide wheel 332 is rotatably connected around the second connecting shaft 331. With the above structure, compared to the non-rotatable guide wheels, the rotatable guide wheels enable the limiting member 3 to move more flexibly and smoothly on the curved track formed by the building blocks, and help to reduce the friction between the limiting member 3 and the block 10, so that the toy car is able to glide on the block 10 more easily. This helps to improve the smoothness of the toy car.

In an embodiment, referring to FIGS. 8-12, the limiting member 3 is connected to a side wall of the housing assembly 1, the limiting member 3 comprises a third limiting arm 34 and a fourth limiting arm 35, and the third limiting arm 34 and the fourth limiting arm 35 are connected to the opposite side walls of the housing assembly 1 respectively. The third limiting arm 34 is provided with a third connecting shaft 341, the third connecting shaft 341 is connected to a third guide wheel 342, the fourth The third limiting arm 34 is provided with a third connecting shaft 341, the third connecting shaft 341 is connected with a third guide wheel 342, the fourth connecting shaft 351 is connected with a fourth guide wheel 352, and the third guide wheel 342 and the fourth guide wheel 352 are used to abut against the side surfaces 102 of the block 10. With the above structure, since the limiting member 3 is connected to the side wall of the housing assembly 1, the housing assembly 1 can be connected to the side wall 102 by the third guide wheel 342 and the fourth guide wheel 352 being attached to the side surface 102 of the block 10. The limiting member 3 can limit the housing assembly 1 and the wheels 2 to the upper surface of the block 10 at all times, effectively realizing the function of limiting, making the toy car run more stably, and greatly reducing the manufacturing cost.

Further, two opposite side walls of the housing assembly 1 are respectively provided with a first connecting member 11 and a second connecting member 12. The first connecting member 11 is provided with a first connecting hole 111. The third limiting arm 34 is provided with a first rotary shaft 343, the first rotary shaft 343 being disposed within the first connecting hole 111. The third limiting arm 34 rotates relative to the housing assembly 1 via the first rotary shaft 343. The second connecting member 12 is provided with a second connection hole 121, and the fourth limiting arm 35 is provided with a second rotary shaft 353. The second rotary shaft 353 is located in the second connection hole 121, and the fourth limiting arm 35 rotates relative to the housing assembly 1 via the second rotary shaft 353. With the above structure, the rotatable and foldable third limiting arm 34 and the fourth limiting arm 35 can be folded into a smaller space when the toy car is not in use. This can reduce the volume when storing and carrying, making the cart easier to carry and store, and convenient for the user to use when needed, effectively realizing the function of the rotatable and collapsible limiting member, thus reducing the volume when storing and carrying, making the toy car easier to carry and store, and convenient for the user to use when needed, and improving the portability and storage convenience of the toy car.

Referring to FIGS. 1 to 12, a toy car system includes a block 10, a toy car, and a limiting member 3. The block 10 has an upper surface 101 and two side surfaces 102.

The toy car includes a housing assembly 1 and two wheels 2 provided on the housing assembly 1 and rotatable relative to the housing assembly 1. The wheel 2 is used to engage on the upper surface 101 of the block 10 and roll along the upper surface 101 of the block 10.

The limiting member 3 is coupled to the housing assembly 1 and abuts against the side surface 102, and the limiting member 3 is used to limit the wheel 2 to the upper surface 101 of the block 10.

With the above structure, in use, the toy car is placed on the block 10 so that the wheels 2 are on the upper surface 101 of the block 10, and the limiting member 3 abuts against the two opposite side surfaces 102 of the block 10. The limiting member 3 is always abutting against the side surfaces of the block 10 when the toy car is moving so that the toy car can be traveled in the aligned, extending direction of the block 10. The wheels 2 provide power for the toy car to move forward through friction. The limiting component 3 can always limit the wheels 2 of the toy car to be located on the upper surface of the block, so that the toy car can run more stably. The design effectively realizes that different shapes of toy cars can be adapted to the same track building blocks, which greatly reduces the manufacturing cost.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A toy car system comprising:

a block, the block having an upper surface and a side surface;

a toy car, the toy car comprising a housing assembly and a plurality of wheels provided on the housing assembly, the plurality of wheels being rotatable with respect to the housing assembly, the plurality of wheels being configured for engaging on an upper surface of the block and rolling along the upper surface of the block; and a limiting member, the limiting member being connected to the housing assembly and for abutting against the side surface, the limiting member being for limiting the plurality of wheels on the upper surface of the block;

wherein the limiting member comprises a first limiting arm, and a second limiting arm, the first limiting arm is provided with a first connecting shaft, the first connecting shaft is connected to a first guide wheel; the second limiting arm is provided with a second connecting shaft, the second connecting shaft is connected with a second guide wheel, the first guide wheel and the second guide wheel are for abutting against the side surface of the block;

wherein a distance between the first guide wheel and the second guide wheel is larger than or equal to a transverse width of the block;

wherein the side surface of the block is flat;

wherein the upper surface of the block is substantially flat, and there is no guide rail formed on the upper surface of the block.

2. The toy car system according to claim 1, wherein the first limiting arm and the second limiting arm are integrally formed.

3. The toy car system according to claim 1, wherein the limiting member is detachably connected to the housing assembly.

4. The toy car system according to claim 1, wherein the first guide wheel is rotatably connected around the first connecting shaft and the second guide wheel is rotatably connected around the second connecting shaft.

5. The toy car system according to claim 1, wherein the first guide wheel has a diameter in a range of 0.5 cm-2.5 cm and the second guide wheel has a diameter in a range of 0.5 cm-2.5 cm.

6. The toy car system according to claim 1, wherein the first guide wheel comprises an abutting surface for abutting against the outmost side surface of the block, and the abutting surface is perpendicular to the upper surface of the block.

* * * * *